US006563495B1

(12) United States Patent
Griepentrog

(10) Patent No.: US 6,563,495 B1
(45) Date of Patent: May 13, 2003

(54) AUTOMATIC SCREEN SAVER

(75) Inventor: Dal Frank Griepentrog, Indianapolis, IN (US)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/582,396

(22) PCT Filed: Dec. 21, 1998

(86) PCT No.: PCT/US98/27126

§ 371 (c)(1),
(2), (4) Date: Nov. 9, 2000

(87) PCT Pub. No.: WO99/34593

PCT Pub. Date: Jul. 8, 1999

(51) Int. Cl.[7] ..... G09G 5/00

(52) U.S. Cl. ..... 345/212; 348/378; 348/377; 345/10

(58) Field of Search ..... 345/10, 22, 204, 345/211, 212; 348/377, 378, 379, 380, 381, 382; 315/380, 383

(56) References Cited

U.S. PATENT DOCUMENTS 4,167,025 A * 9/1979 Willis ..... 358/243
4,253,121 A 2/1981 Avery
4,338,623 A * 7/1982 Asmus et al. ..... 358/22
4,549,217 A * 10/1985 Sendelweck ..... 358/243
5,216,335 A * 6/1993 Lee ..... 315/383
5,880,719 A * 3/1999 Kikinis ..... 345/212
6,313,878 B1 * 11/2001 Jankowiak ..... 348/377

OTHER PUBLICATIONS

Patent Abstracts of Japan, vol. 098, No. 004, Mar. 31, 1998 & JP 09327031, Abstract from Derwent.

Patent Abstracts of Japan, vol. 097, No. 005, Apr. 30, 1997 & JP 09006273A, Abstract from Derwent and full translation of JP patent.

European Search Report dated Apr. 22, 1999.

* cited by examiner

*Primary Examiner*—Kent Chang
(74) *Attorney, Agent, or Firm*—Joseph S. Tripoli; Joseph J. Laks; Frank Y. Liao

(57) ABSTRACT

A method and system for implementing a screen saver function is described. A peak value of a characteristic such as beam current magnitude of a video signal being processed is determined. An average value of the same characteristic of the video signal is also determined. Changes in this average value is additionally monitored. Therefore, the characteristic of the video signal is adjusted only if the peak value exceeds a first threshold and a change less than a second threshold is detected in the average value.

8 Claims, 4 Drawing Sheets

AUTOMATIC SCREEN SAVER

FIELD OF THE INVENTION

The present invention generally relates to a screen saver apparatus and method, and in particular, to a screen saver apparatus and method based on monitoring the various changes of the signal representing an image being processed.

BACKGROUND OF THE INVENTION

Screen saver applications for computer systems are well known. The purpose of a screen saver application is to prevent the burning of a fixed pattern onto the phosphor screen of a display, when there is little or no screen activity. The common way of detecting this inactivity is to monitor whether there is any user keyboard input. In other words, a timer is started after each keyboard entry and if the timer expires before another entry, then the screen saver application will cause the screen to go blank or display a predetermined moving image, thereby preventing screen burn. The screen will be restored as soon as another keyboard entry is detected.

Other prior screen saver systems take the approach of looking at the motion of the images being displayed. For example, Japanese Patent No. 6332418 A, assigned to Fujitsu General Ltd. of Japan, discloses a screen saver apparatus having a motion adaption circuit.

The motion adaption circuit examines a video signal and determines the motion characteristics of the corresponding image. If a still picture is detected, a timer is started. If the still picture is displayed after a predetermined time period, the power supply to the display is cut off, thereby preventing screen burn. These motion based systems are, however, complicated and typically requires costly digital processing circuitry to determine whether a motion is present. In addition, these systems enable the screen saver function based solely on the motion factor and nothing else, which may cause unnecessary blanking of the screen.

Another prior system is disclosed in Japanese patent publication number 09327031. This system determines the peak beam current value of one frame of video for a particular period. The system also detects the motion of an image based on an inter-frame of video reference. Thereafter, a brightness control unit reduces the beam current of the CRT gradually to a reference current value corresponding to the reference voltage value during the still picture display.

The above system, however, requires complicated and expensive circuitries. In particular, it detects the relative motion of an image by using a motion of an image by using a motion adaptive 3-dimension YC separation system. Theis requires costly components such as A/D converters and digital frame stores.

The present inventor recognizes the advantages of being able to implement a screen saver function for a multi-media display in a cost effective manner, preferably using the circuitry that is already being used for other functions.

In addition, the present inventor recognizes that there is no need to blank the screen, even if the screen is static for a period of time, if the image being displayed has characteristics that do not exceed certain thresholds. In other words, even if a screen image is static, there may be little chance of screen burn if the image being displayed is of low brightness and/or contrast, for example.

Therefore, in one exemplary embodiment, a method and system for implementing a screen saver function is described. A peak value of a characteristic such as beam current magnitude of a video signal being processed is determined. An average value of the same characteristic of the video signal is also determined. Changes in this average value is additionally monitored. Therefore, the characteristic of the video signal is adjusted only if the peak value exceeds a first threshold and a change less than a second threshold is detected in the average value.

Figure 1:
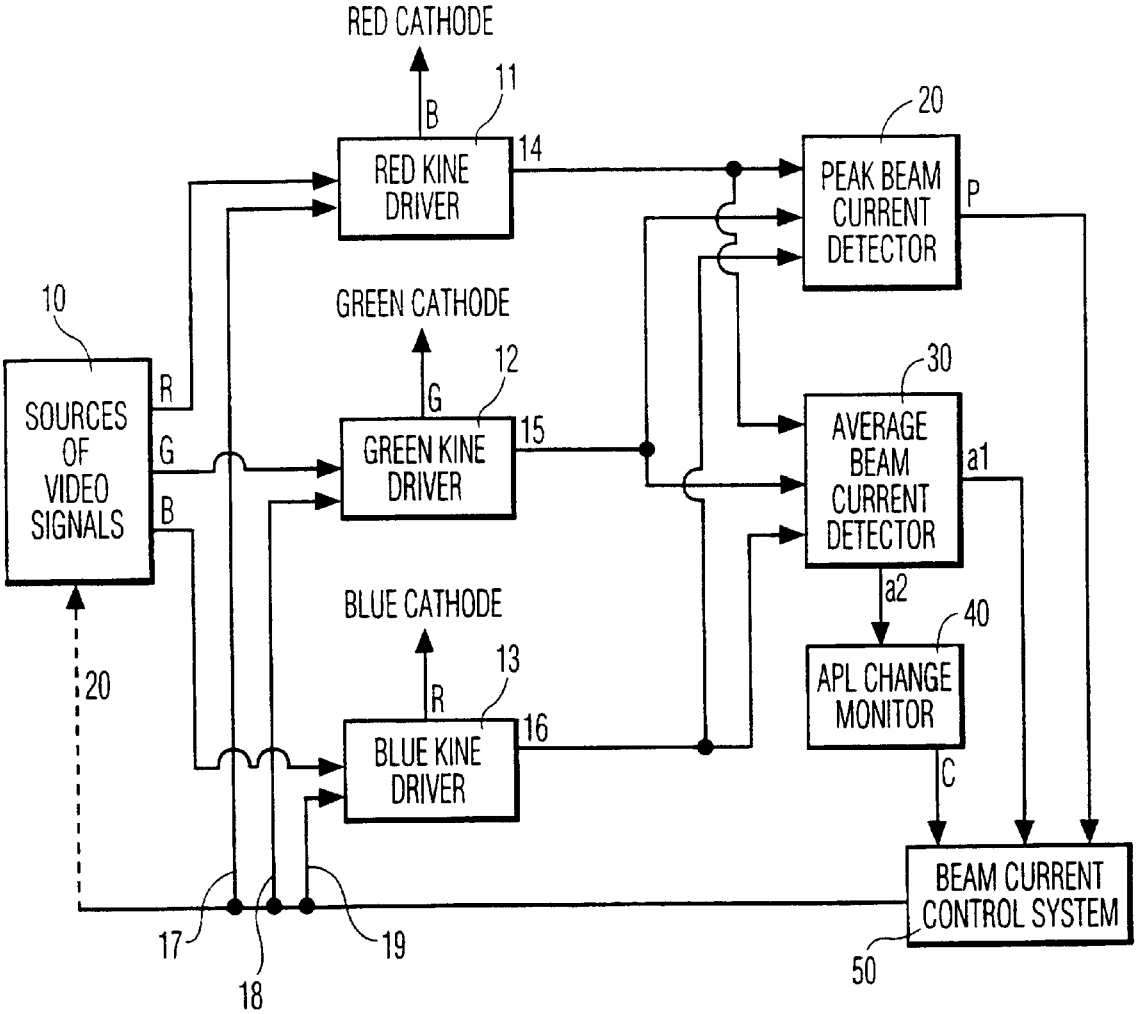
FIG. 1 shows a block diagram of an exemplary embodiment of the video processing apparatus in accordance with the present invention.

FIG. 1 shows a block diagram of an exemplary embodiment of the video processing apparatus in accordance with the present invention. A source of video signals are shown having low level color signals red (r), green (g) and blue(b). The sources of the signals may be from a device such as a television receiver, a computer, etc. Each of the respective signals r, g, b is coupled to a respective one of driver amplifiers 11–13. Each of the driver amplifiers 11–13 provides a respective output signal Red(R), Green(G) or Blue (B) to drive a respective node of a display device (not shown), such as a respective cathode of a kinescope or a cathode ray tube (CRT).

Additionally, a peak beam current detector 20 is coupled to current measurement outputs 14–16 from each of the driver amplifiers 11–13 respectively. Each of the current measurement outputs provides a signal representing the magnitude of the cathode current going into the respective node of the display device. The it peak beam current detector 20 provides an output signal p which indicates the magnitude of one of the cathode currents of the driver amplifiers 11–13. This output signal p is fed to a beam current control system 50 whose function will be described in detail below.

The current measurement outputs 14–16 are also coupled to an average beam current detector 30. The function of the average beam current detector 30 is to provide an output signal a2 which indicates the average beam current value of the cathode currents.

Output signal a2 is then coupled to an APL change monitor. The present inventor has recognized that monitoring the changes in the Average Picture Level (APL) of a video signal is an efficient and cost effective way to determine whether the corresponding image is static or not. The inventor has further recognized that an effective way to monitor changes in the APL is to look, instead, at changes in the average beam current. In other words, a change in APL indicates a change in motion in a video image; and a change in the average beam current indicates a change in the APL. Therefore, the exemplary embodiment of FIG. 1 monitors changes in the average beam current for determining whether the display is static or not, according to an aspect of the present invention.

Hence, the APL change monitor 40 monitors output signal a2 indicating magnitude of an average beam current from the detector 30, and in response, provides an output signal c indicating whether there is a change in the APL. This output signal c is also coupled to beam current control system 50 of the video apparatus as shown in FIG. 1.

Another exemplary output of the average beam current detector 30 is signal al which is coupled directly to the beam current control system 50 of the present invention. Output signal al indicates an average value of beam currents being processed. Signal al is commonly used by the beam current control system 50 to adjust the D.C. level of the video apparatus, as disclosed for example, in U.S. Pat. No. 4, 253,121, issued in the name of Avery on Feb. 24, 1981.

In addition to receiving signal al, the beam current control system 50 also receives signals p and c which are generated as described above. In response to these input signals, beam current control system 50 provides control signals 17–19 for adjusting the kine drive currents R, G, and B of the driver amplifiers 11–13. In addition, beam current control system 50 may adjust the brightness and/or contrast of the video signals from the video signal sources by providing control signal 20 in a known manner.

Figure 2A:
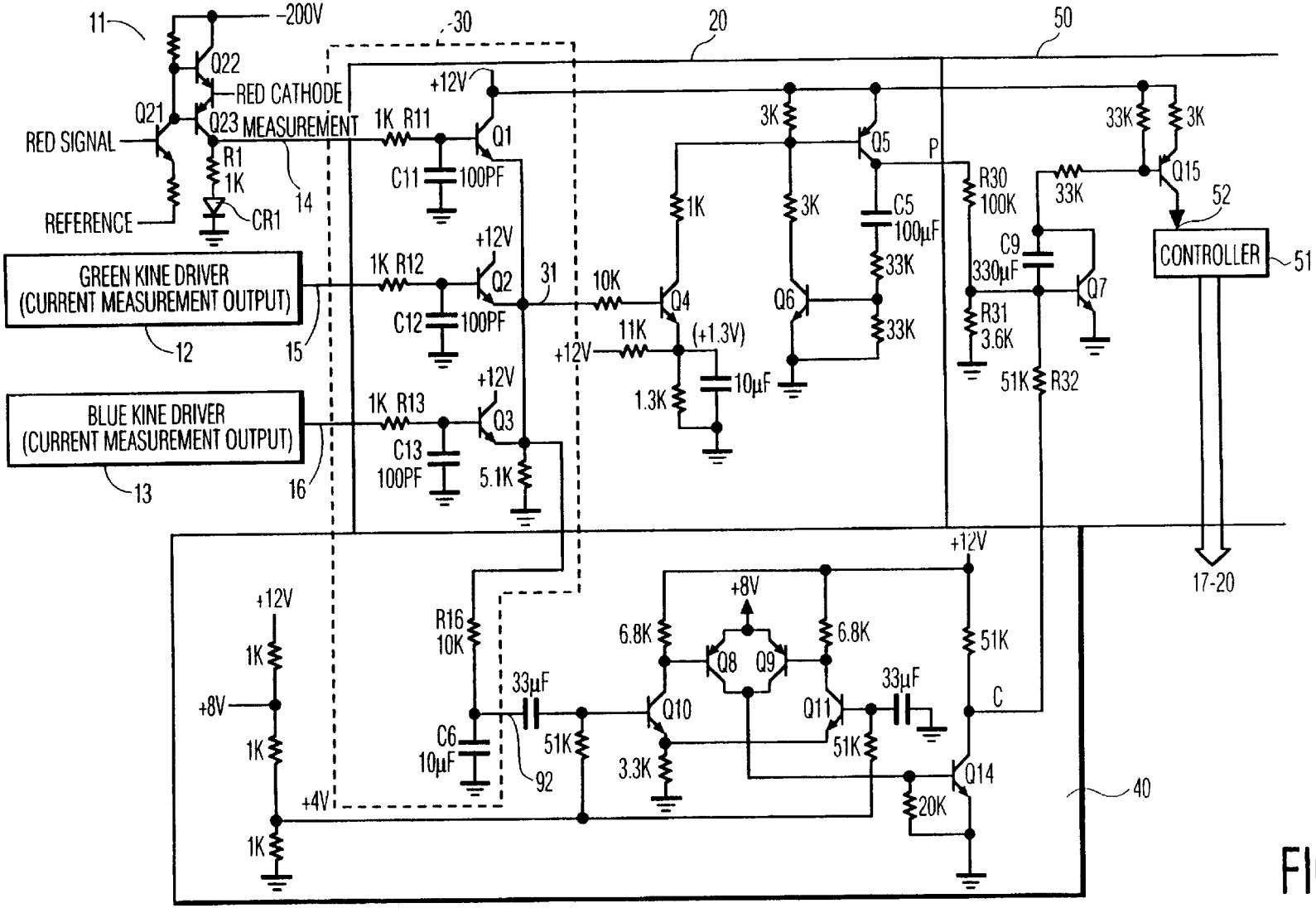
FIG. 2A shows in detail an exemplary circuitry for implementing an exemplary embodiment of the present invention.

FIG. 2A shows an example of the detailed implementation of apparatus shown in FIG. 1.

A typical kine driver amplifier 11 is shown having transistors Q21–Q23. The red signal (r) from the signal source 10 shown in FIG. 1 is connected as the input at the base of transistor Q21. The output of the driver 11 is taken from the emitter of transistor Q2 and is connected to the red cathode node of a display such as a CRT, for example (not shown).

A measurement resistor R1 is connected in series with a measurement diode CR1 at the collector of the PNP buffer transistor Q23. The collector of transistor Q23 also serves as the current measurement output 14. The measurement output 14 is coupled to both detectors 20 and 30 as described below and shown in both FIGS. 1 and 2. Green and blue driver amplifiers 12 and 13 have the same construction as that of the red driver amplifier 11 and therefore are not shown or discussed in detail.

The operation of the peak beam current detector 20 will be described first with respect to the exemplary embodiment of the present invention shown in FIG. 2A. A cathode current of 2 ma in either of the red, green or blue driver amplifier will produce about 2 volts at the emitters of Q1, Q2 or Q3. This is because, in the case of Q1, the voltage drop across diode CR1 and resistor R1 matches the base-to-emitter voltage drop of transistor Q1. Similar arrangements of measurement diodes and resistors for driver amplifiers 12 and 13 are used but not shown. The highest cathode current of the three measurement outputs is then detected at point 31 of detector 20.

The emitter of transistor Q4 is biased such that Q4 conducts when the highest cathode current exceeds 2 ma. This conduction causes transistors Q5 and Q6 to latch on until capacitor C5 charges up. A continuous level of a beam current above 2 ma will cause Q5 to remain saturated. Therefore, output p of the peak beam current detector 20 will go high. when one of the cathode beam currents R, G.

B exceeds 2 ma.

The operation of the average beam current detector 30 will now be described. Circuit 30 is shown enclosed by dotted lines. Circuit 30 shares part of its circuitry with detector 20 described above, namely components Q1–Q3 and associated resistors R11–R13, and capacitors C11–C13. As described above, output 31 from these components is a signal representing the magnitude of the highest beam current in either of the red, green or blue drivers 11–13. This output 31 is then connected to an integrator formed by R16 and C6 connected in series. Output a2 from the integrator of R16–C6 thus represents the average value of the highest beam current detected.

This filtered output signal a2 is then connected to an input of an APL change monitor 40. As shown in FIG. 2A, an exemplary APL monitor comprises a differential comparison circuit comprising of Q8–Q14. A change in the input level a2 either positive or negative causes either Q8 or Q9 to conduct and therefore causes Q14 to conduct. The output of Q14 is therefore high when there is no change in the average beam current, indicating that the displayed image is static.

An example of a beam current control system is shown as block 50 which receives signals from outputs p and c of detectors 20 and 40 respectively. These signals are coupled through resistors R30 and R32 respectively to a transistor Q7. Transistor Q7 will conduct slowly and causes Q1S to conduct slowly when the peak beam current detector 20 indicates that 2 ma is exceeded in one of the beam currents (i.e. Q5 has a high output), and detector 30 senses no change in APL (i.e., Q14 output is high) indicating no motion. The filter capacitor C9 is connected in a feedback path to produce a long time constant.

The current output of Q15 may be connected to, for example. a video controller or microprocessor 51 which monitors the sense point 52 and in response, provide beam current drive control signals 17–19. and/or 20 as shown in FIG. 1, and discussed above. Alternatively, sense point 52 of Q15 may be connected to an analog circuit or discrete log-c which may provide equivalents of control signals 17–19, and/or 20, in a known manner.

Figure 2B:
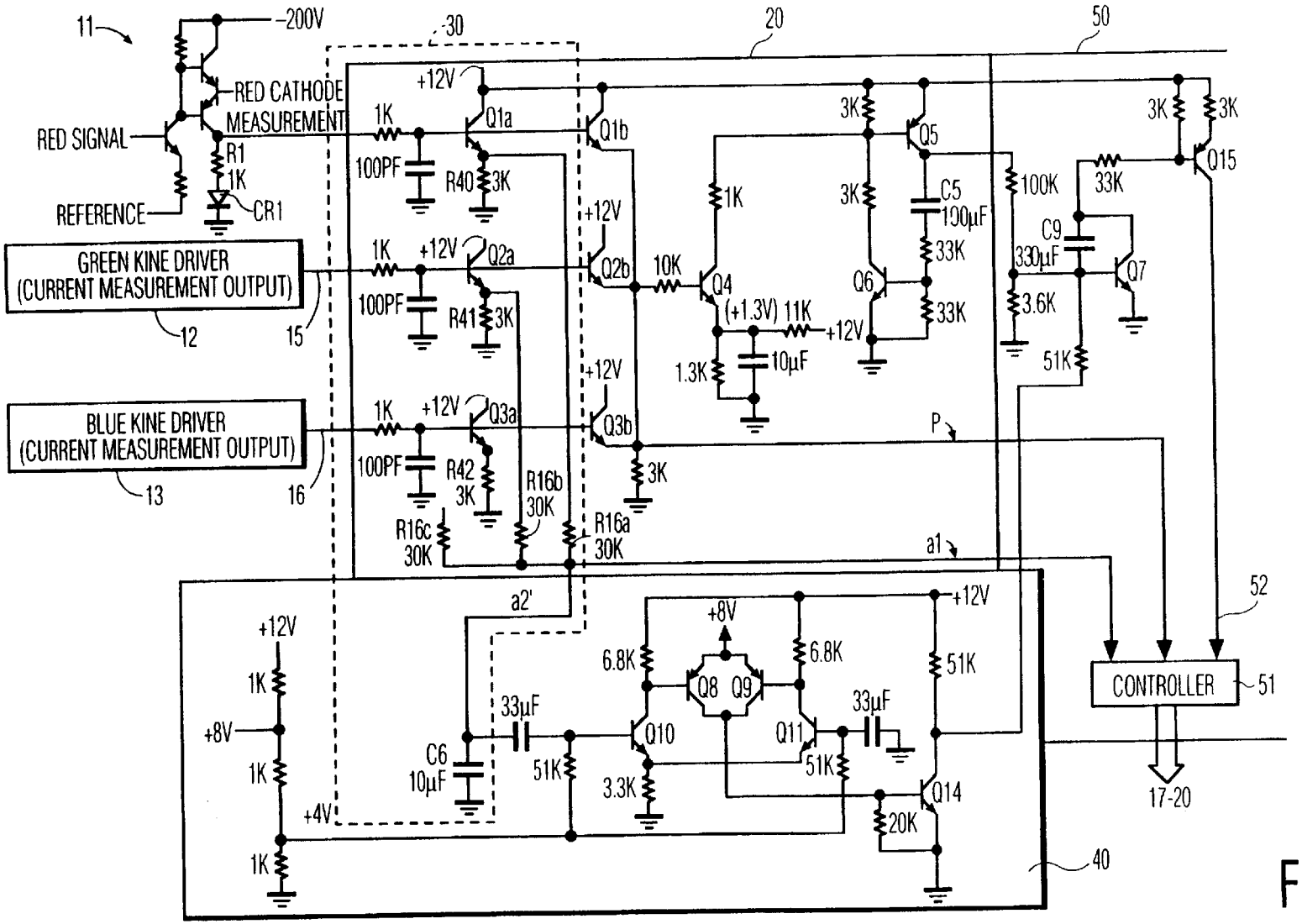
FIG. 2B shows in detail another exemplary circuitry for implementing the present invention.

FIG. 2B also shows in detail, another exemplary embodiment in circuit diagram form of the present invention. Since most of circuitry shown in FIG. 2B is similar as that shown in FIG. 2A, FIG. 2B will not be discussed in detail.

The main difference between the embodiment shown in FIG. 2A and FIG. 2B is the addition of transistors Q1*a*–Q3*a* and their associated resistors R16*a*–R16*c* and R40–R42 in FIG. 2B. Because of the addition of these components, a signal al is now available. Signal al represents an average of all three beam currents R, G, B in the respective kine driver amplifiers 11–13 as shown in block diagram of FIG. 1 and was discussed above in connection with FIG. 1. Signal al in FIG. 2B is then coupled to beam current control system 50, and it is used to control, for example, the D.C. level of the video signal sources r, g, and b, as discussed above, in connection with FIG. 1.

Additionally, the same signal may also be used by APL change monitor 40 to determine whether or not there is a change of motion in the video signal. This signal is indicated by signal a2' in FIG. 2B. In other words, signal a2' in FIG. 2B indicates a value of the average of all three beam currents R. G. B. whereas signal a2 in FIG. 2A indicates the average value of the highest beam current of the three beam currents R, G, B, as described in connection with FIG. 2A.

Figure 3:
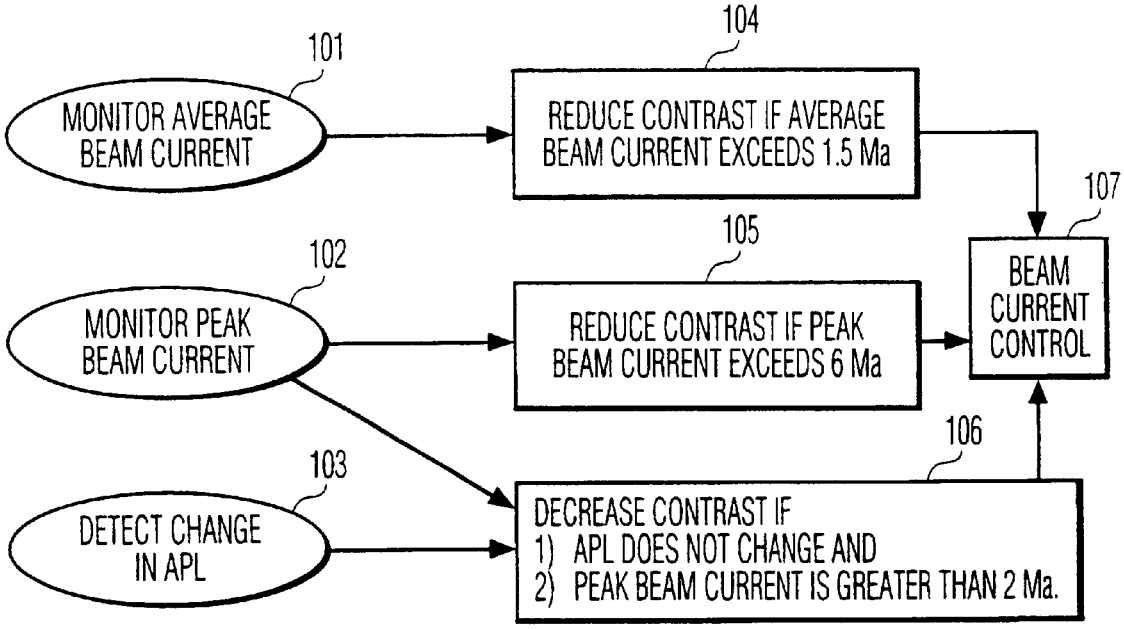
FIG. 3 shows a process diagram of an exemplary embodiment of the present invention.

FIG. 3 shows the process of implementing a screen saver function in accordance with the present invention. The steps will now be explained in connection with the embodiments shown in FIGS. 1 and 2.

As shown in step 101 of FIG. 3, signal al representative of the average beam current of a video signal being processed is monitored by the beam current control system 50 of FIG. 1. If, for example. the average beam current being monitored exceeds a first predetermined level such as. for example, 1.5 ma, a control signal is generated to reduce the contrast of the displayed video signal, as shown in steps 104 and 107 of FIG. 3.

As shown in step 102, another signal p representative of the peak value of a characteristic such as the beam current magnitude of the video signal being processed is also monitored by the beam current control system 50 of FIG. 1. If, for example, the peak beam current being monitored exceeds another predetermined level such as, for example, 6 ma, a control signal is also generated to adjust the beam current magnitude of the displayed video signal, as shown in steps 105 and 107 of FIG. 3.

Finally, as shown in step 103, changes in the Average Picture Level (APL) is also monitored to determine whether there is motion in the image being processed. As described before, changes in the APL may be determined by monitoring changes in the average value of beam current magnitude, as shown in the exemplary circuits 30 and 40 of FIGS. 2A or 2B. Therefore, as shown in steps 106 and 107, only when peak beam current exceeds another predetermined level, such as, for example, 2 ma and when no change in APL (e.g., APL change does not exceed a certain threshold), will a control signal be generated to adjust the beam current characteristic of the displayed video signal. Although steps 104–106 show only the process of reducing contrast of the video signal as examples of beam current control, it would also be feasible to reduce the brightness of the video signal, or to reduce both the contrast and the brightness to achieve the desired results.

The invention described above relates to an implementation of a screen saver function. The invention allows a display to operate at maximum average and peak beam currents if the displayed pattern is changing with time, and would operate at reduced peak beam current (e.g., 2 ma) when no change, or a change less than a threshold in pattern is detected. The maximum peak beam current capability (e.g., 6 ma) would be restored when the pattern changes. This screen saver function is especially helpful for projection display monitors since it is advantageous to be able to operate a projection display at maximum peak and average beam current for easier viewing. This invention of course could be used with any monitor, such as a computer monitor or a television display.

It is to be understood that the embodiments and variations shown and described herein are for illustrations only and that various modifications may be implemented by those skilled in the art without departing from the scope and spirit of the invention.

What is claimed is:

1. A signal processing apparatus for processing a video signal (r, g, b), comprising:

a peak detector for determining a peak beam current value corresponding to said video signal, an average detector for determining an average beam current value corresponding to said video signal; and a controller for adjusting a characteristic of said video signal in response to said peak beam current value exceeding a first threshold and a change in said average beam current value less than a second threshold.

2. The apparatus as in claim 1, wherein said characteristic is contrast of said video signal.

3. The apparatus as in claim 1, wherein said characteristic is brightness of said video signal.

4. The apparatus as in claim 1, wherein said change in said average beam current value is monitored by a change monitor.

5. The apparatus as in claim 1, wherein said controller adjusts said characteristic by reducing it.

6. A method of implementing a screen saver function, comprising the steps of:

determining a peak value of a video signal being processed;

monitoring an average value of said video signal;

determining whether there is a change in said average value of said video signal; and adjusting said video signal only if said peak value exceeds a first threshold and a change is detected in said average value.

7. The method of claim 6, wherein said video signal is adjusted only if the change in said average value is less than a second threshold.

8. The method of claim 6 wherein said average value corresponds to average picture level of an image represented by said video signal.

* * * * *